United States Patent [19]

Bershadsky

[11] Patent Number: 5,049,119

[45] Date of Patent: Sep. 17, 1991

[54] APPARATUS FOR REMOVING A FLAT CARTON FROM A MAGAZINE, CAUSING THE CARTON TO OPEN, AND PLACING THE CARTON IN A CONVEYOR ASSEMBLY

[76] Inventor: Boris Bershadsky, 20982 Calle Celeste, El Toro, Calif. 92630

[21] Appl. No.: 546,892

[22] Filed: Jul. 2, 1990

[51] Int. Cl.[5] ..... B31B 5/80; B31B 1/78

[52] U.S. Cl. ..... 493/315; 493/317

[58] Field of Search ..... 493/315, 317, 318

[56] References Cited

U.S. PATENT DOCUMENTS

| | | | |
|---|---|---|---|
| 2,601,481 | 6/1952 | Williams | 493/315 |
| 2,936,681 | 5/1960 | Earp | 493/315 |
| 3,242,827 | 3/1966 | Winters | 493/315 |
| 3,599,541 | 8/1971 | Allen | 493/315 |
| 4,194,442 | 3/1980 | Martelli | 493/315 |
| 4,537,587 | 8/1985 | Langen | 493/315 |
| 4,596,545 | 6/1986 | Greenwell | 493/315 |

*Primary Examiner*—William E. Terrell

*Attorney, Agent, or Firm*—Thomas I. Rozsa

[57] ABSTRACT

An automatic processing machine used in the packaging industry which automatically removes a folded cardboard box or carton from a rack or magazine of such folded boxes or cartons and causes the box or carton to be opened such that the four walls and base or bottom are in the opened position while the top is not closed, and simultaneously causing the opened box to be placed on a moving conveyor assembly which then moves the opened box to a loading station where goods can be placed into the opened box or carton. The machine is in the form of a rotating carousel having operating stations which rotate with the carousel but also rotate in the direction opposite to the direction of rotation of the carousel to enable the linear velocity of the attachment members to be zero when they attach to the stationary box or carton to assure that the attachment will be secure and the carton will not fly off. The carton is partially opened by the operating station on the carousel and the conveyor assembly is positioned relative to the carousel to cause the retained partially opened carton to be fully opened upon impact with a retaining member of the conveyor assembly.

3 Claims, 4 Drawing Sheets

APPARATUS FOR REMOVING A FLAT CARTON FROM A MAGAZINE, CAUSING THE CARTON TO OPEN, AND PLACING THE CARTON IN A CONVEYOR ASSEMBLY

BACKGROUND OF THE INVENTION

1. FIELD OF THE INVENTION

The present invention relates to the field of automatic processing machinery in the packaging industry which is designed to automate manual operations and thereby provide an efficient and cost effective method for performing operations formerly performed by expensive manual labor. In particular, the present invention relates to automatic machinery which is designed to remove a flat carton from a magazine having a multiplicity of flat cartons retained therein, cause the carton to be opened, and thereafter deposited on a conveyor assembly in a manner which permits the carton to be the opened position and ready to receive goods which are placed in the opened carton as it moves along the conveyor assembly.

2. DESCRIPTION OF THE PRIOR ART

In general automatic machinery which automates operations previously performed by manual labor are well known in the prior art. In general, machinery which is placed on a carousel and caused to rotate in the clockwise or counterclockwise direction while causing operating components on the machine to move from station to station while performing one or more tasks are also generally well known in the prior art. In addition, operating components such as gear and sprocket assemblies which cause the rotation of the carousel and also the rotation of one or more operating stations on the carousel, and pneumatic air valve or cam and cam follower assemblies which cause rods to move back and forth are also well known in the prior art. Finally, assemblies such as pneumatic suction cups are also well known in the prior art.

SUMMARY OF THE PRESENT INVENTION

The present invention is an automatic processing machine used in the packaging industry which automatically removes a folded cardboard box or carton from a rack or magazine of such folded boxes or cartons and causes the box or carton to be opened such that the four walls and base or bottom are in the opened position while the top is not closed, and simultaneously causing the opened box to be placed on a moving conveyor assembly which then moves the opened box to a loading station where goods can be placed into the opened box or carton.

It has been discovered, according to the present invention, that if a movable suction source attaches itself to one panel or wall of a folded box and causes the box to be move toward a pair of fixed posts which are aligned at a given position relative to the box panels, then the force of the box hitting the fixed posts will cause the fold of the box to break and partially open the box.

It has been further discovered, according to the present invention, that if the process machine is positioned on a carousel which is caused to rotate in one direction and the operating station on the carousel is caused to rotate in the opposite direction, then by adjusting the speed of rotation of the carousel and the operating station, the linear velocity at the location of the suction attaching and retaining means can be caused to be zero at the moment the suction attaching and retaining means attaches itself to the cardboard box or carton. It has been discovered that if the relative linear velocity of the suction attaching and retaining means from source to the box or carton is zero at the moment the suction attaching and retaining means attaches itself to the box or carton, then the box or carton can be efficiently removed and pulled by the suction source to the waiting fixed posts which will cause the box or carton to break open. Conversely, if the relative linear velocity of the suction attaching and retaining means is not zero at the time the suction attaching and retaining means is attached to the box resting in the magazine, the box will fly off the suction attaching and retaining means and will not remain stationary to be opened by the fixed posts.

It has additionally been discovered that if a multiplicity of spaced apart operating stations are set on the rotating carousel with each operating station rotating in the same direction and all rotating in a direction opposite to the rotation of the carousel, then the operation of causing the rotation of the operating stations relative to the carousel rotation to thereby create a relative linear velocity of zero at the time each suction attaching and retaining means attaches itself to a box can be performed for a multiplicity of operations as the carousel rotates, thereby enabling the box removal and opening to be performed a multiplicity of times during each 360 degree rotation of the carousel.

It has further been discovered, according to the present invention, that if a continuously running conveyor assembly machine has a receiving means including protruding transverse walls which protrude in a direction toward the rotating carousel as the receiving means becomes positioned adjacent the carousel and operating stations, and the relative motion of the conveyor assembly and box receiving means is opposite to the relative direction of rotation of the operating station having the suction attaching and retaining means and the retained partially opened box, then the corner of the partially opened box remote from the suction attaching and retaining means can be caused to hit a protruding transverse wall on the conveyor assembly machine to thereby cause the box to be completely opened, at which time the suction attaching and retaining means releases the fully opened box and enables it to rest between the pair of protruding walls as the box rests adjacent the conveyor assembly. If the conveyor assembly is a horizontally moving assembly, the bottom of the box can rest on the conveyor assembly and is retained between a set of protruding walls. If the conveyor assembly is a vertically moving assembly, then a sidewall of the box rests against the conveyor assembly and is retained between a set of protruding walls.

An improvement in large cartons is the innovation of incorporating an interior bag with the walls of the bag adhered to the inside of the box or carton. This enables more ingredients to be placed within the bag as opposed to the conventional method of filling a bag and then inserting it in the box. It has been discovered that through use of the present invention with the box or carton partially opened upon impact of the box or carton against fixed posts, with the operating station continuing to spin with the retained box or carton between the time the box or carton is removed from the magazine and the time it is inserted into the conveyor assembly, the spinning aids in causing the box or carton and the interior bag to be entirely opened when the box or carton is inserted into the conveyor assembly.

It is therefore an object of the present invention to provide an automatic processing machine which can remove a flat box or carton from a magazine, cause the box or carton to be opened and thereafter placed on a conveyor assembly in the opened position so that goods can be subsequently placed in the carton.

It is a further object of the present invention to provide a compact and efficient processing machine for opening boxes or cartons wherein the machine is a rotating carousel having a multiplicity of operating stations so that a multiplicity of box opening operations can be performed during each rotation of the carousel.

It is another object of the present invention to provide an efficient operating means for removing a selected one of a series of flat folded boxes or cartons from a magazine resting adjacent a carousel by suction means including suction attaching and retaining means which have a relative linear velocity of zero relative to the stationary carousel and folded boxes at the moment of impact when the suction attaching and retaining means attaches itself to the selected box, thereby assuring that the suction attaching and retaining means will retain the box and the box will not fly off due to the rotation of the carousel.

It is an additional object of the present invention to provide a box opening machine which is coordinated with a conveyor assembly for retaining the opened box so that the box is partially opened when it is removed from the box retaining magazine and thereafter is fully opened at the time the partially opened box is brought into alignment with box retaining means on the conveyor assembly, to thereby create an efficient system where the folded box is first partially opened while it is attached to the suction attaching and retaining means on the moving carousel and thereafter fully opened just as it is positioned within the retaining means of the conveyor assembly, all in a manner such that the box is fully opened on the conveyer assembly and ready to receive goods to be placed therein as the conveyor assembly and box are moved to a loading station.

It is another object of the present invention to provide a means for opening folded boxes and placing them on a moving conveyor assembly system in the opened position through any number of apparatus means such as gear and sprocket assemblies, belt assemblies, and cam and cam follower assemblies.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration and not limitation, there is illustrated.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
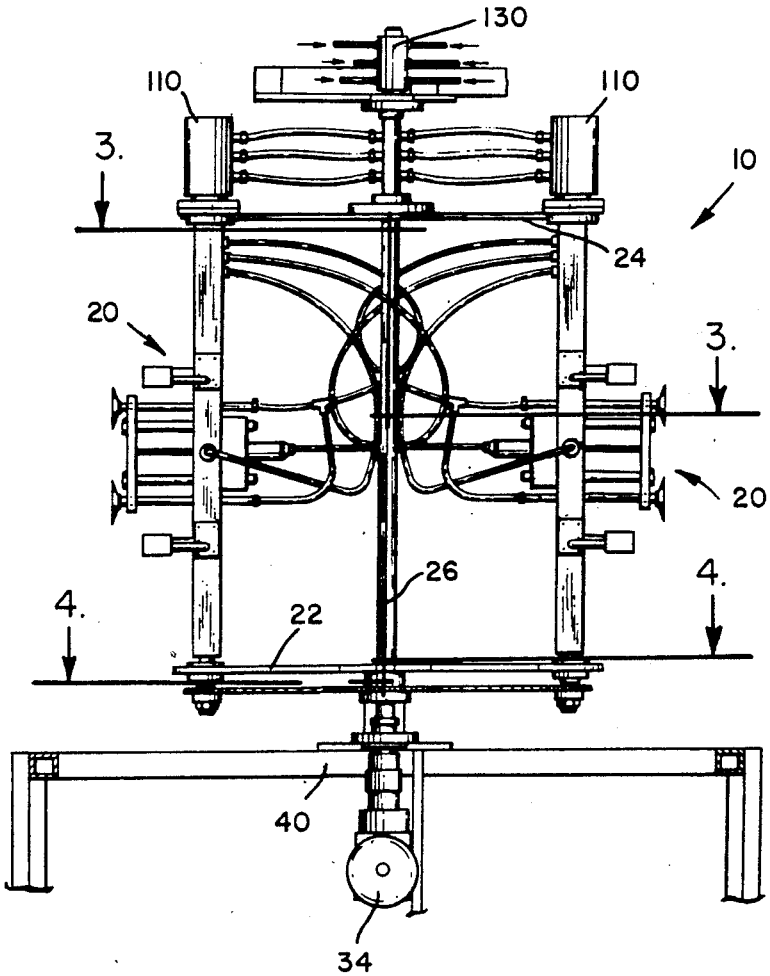
FIG. 1 is a side elevational view of an embodiment of the present invention processing machine for opening and retaining folded flat cartons and positioning them on a conveyor assembly system, illustrating two operating stations on the machine carousel and utilizing a pneumatic air valve assembly for moving the suction attaching and retaining means into the carton attaching position and subsequently retracting it.
Figure 2:
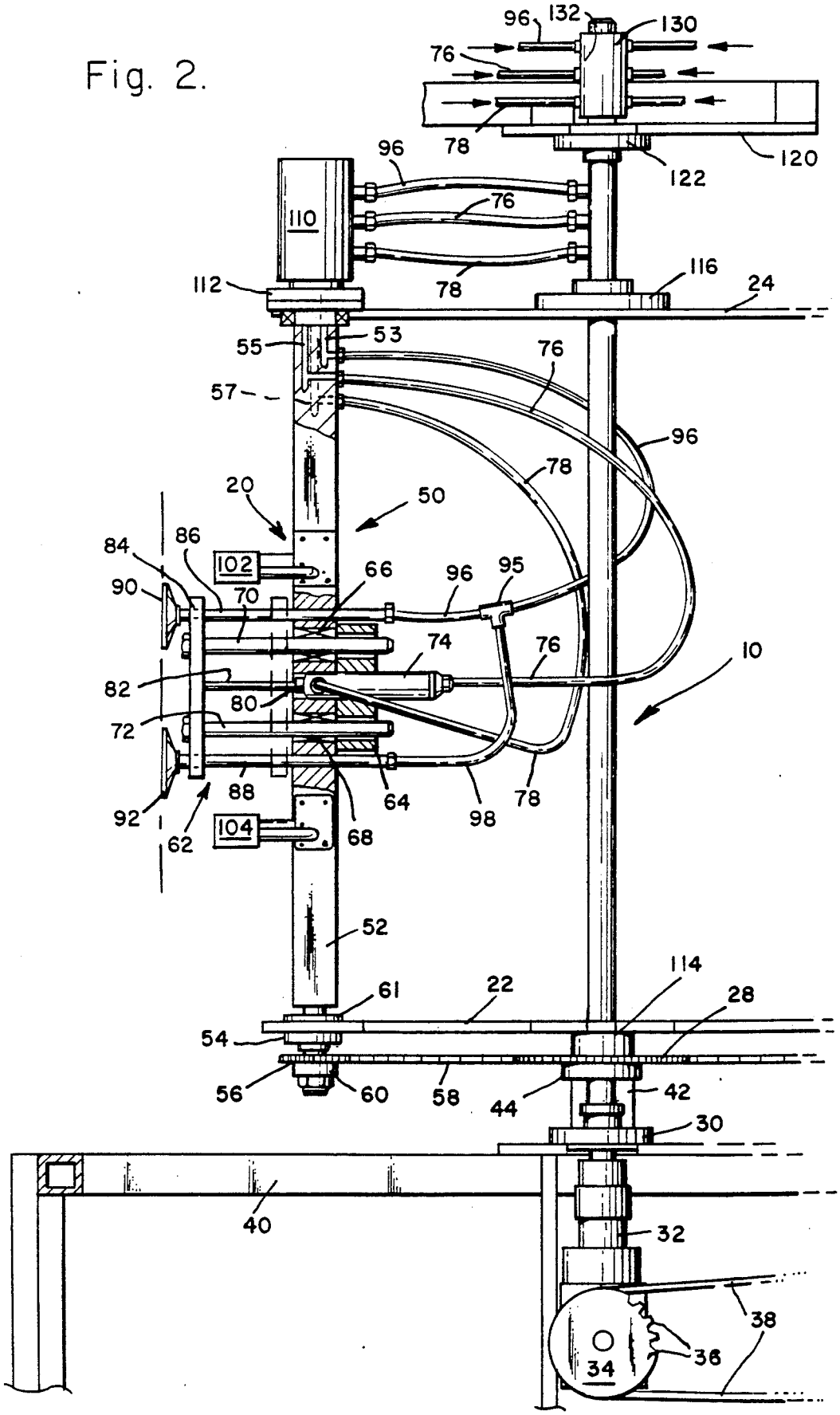
FIG. 2 is a side elevational view in partial cross-section of one of the operating stations and the major operating components of the present invention processing machine for opening and retaining folded flat cartons and positioning them on a conveyor assembly system, and utilizing a pneumatic air valve assembly for moving the suction attaching and retaining means into the carton attaching position and subsequently retracting it.

Referring to FIGS. 1 and 2, there is illustrated at 10 an preferred embodiment of the present invention processing machine for opening and retaining folded flat cartons and positioning them on a conveyor system which includes attaching and receiving means to hold the opened carton, with the machine employing a gear or sprocket assembly for rotation. The machine is illustrated in FIG. 1 with two operating stations on the carousel. It will be appreciated that any multiplicity of operating stations on the carousel are within the spirit and scope of the present invention and the number of operating stations utilized can be increased by conventional means. The carousel 20 comprises a base plate 22 and a top plate 24 separated by a central post 26 The central post 26 extends through the base plate 22, and through a main sprocket 28, through a first bearing 30, through a coupling member 32 and to a gear reducer 34. The gear reducer 34 in turn is connected to the main drive (not shown) by conventional means such as chain 38 movably connected to sprockets 36 on the gear reducer member 34. The main drive on the machine causes the gear reducer to rotate at a given speed which in turn causes central post 26 to rotate and thereby rotates the carousel 20. The main sprocket 28 is connected in a fixed manner to the fixed base 40 of the entire machine 10 by a fixed side plate 42. A second bearing 44 is inside main sprocket 28 and therefore central shaft 26 can rotate inside main sprocket 28 without causing the main sprocket 28 to move. As a result, the bottom plate 22 rotates as the central shaft 26 rotates, and the main sprocket 28 remains stationary since it is attached to fixed base 40.

Figure 4:
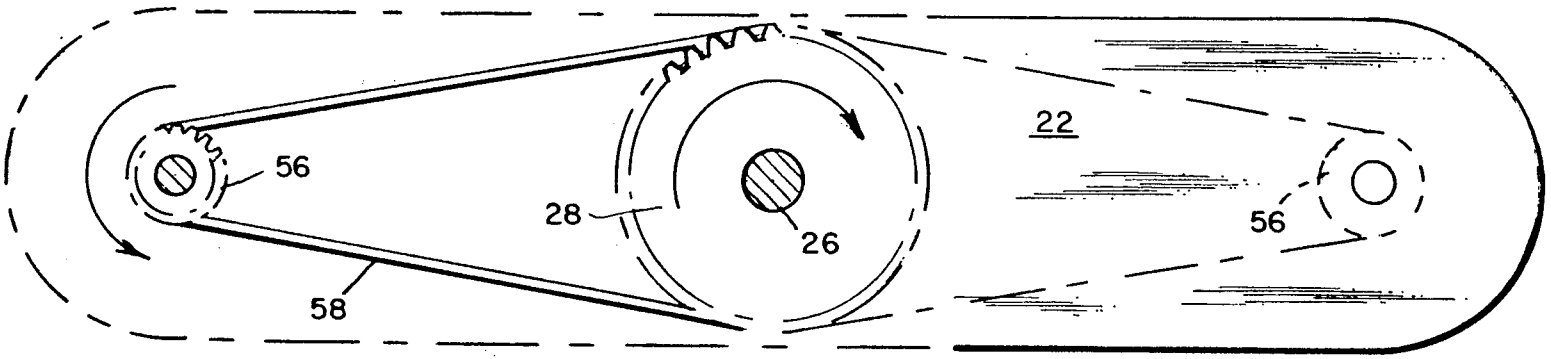
FIG. 4 is a cross-sectional view taken along line 4—4 of FIG. 1.

The operating stations are rotatably attached between the top plate 24 and base plate 22 of the carousel 20. Since each operating station is identical, only one will be described in detail. Operating station 50 comprises a station post 52 which extends through base plate 22, and extends through third bearing 54 immediately beneath base plate 22. At the lower end of the station post 52 is an outer sprocket 56 which is fixed to station post 52. The outer sprocket 56 is connected to main sprocket 28 by a chain 58. This assembly is illustrated in greater detail in FIG. 4. At the bottom of the station post 52 is a shaft collar 60. The station post 52 is rotatable and is caused to rotate by the chain and sprocket assembly just described. A bearing 61 permits station post 52 to rotate within base plate 22. As the main drive means causes the central post 26 and the base plate 22 to rotate for example in the clockwise direction, the fact that the main sprocket 28 is fixed causes the outer sprocket 56 to be rotated by the chain 58 in the counterclockwise direction. As a result, station post 52 also rotates in the counterclockwise direction.

As the main drive motor means causes the post 26 and base plate 22 and top plate 24 to rotate for example in the clockwise direction, the fact that main sprocket 28 is fixed and does not rotate causes outer sprocket 56 and its station post 52 to rotate in the opposite or counterclockwise direction. By adjusting the distances between main sprocket 28 and outer sprocket 56 and adjusting the size of main sprocket 28 relative to outer sprocket 56, the speed of rotation of the station post 52 of operating station 50 can be adjusted relative to the speed of rotation of central post 26, base plate 22 and top plate 24.

Operating station 50 further comprises suction means which terminate in a suction attaching and retaining means assembly 62. The purpose of causing operating station 50 to rotate in a direction opposite to the rotation of carousel 20 and at a given relative speed of rotation relative to carousel 20 is the requirement that the relative linear velocity of suction attaching cups 90 and 92 be zero relative to a stationary object adjacent to the suction attaching cups.

Figure 3:
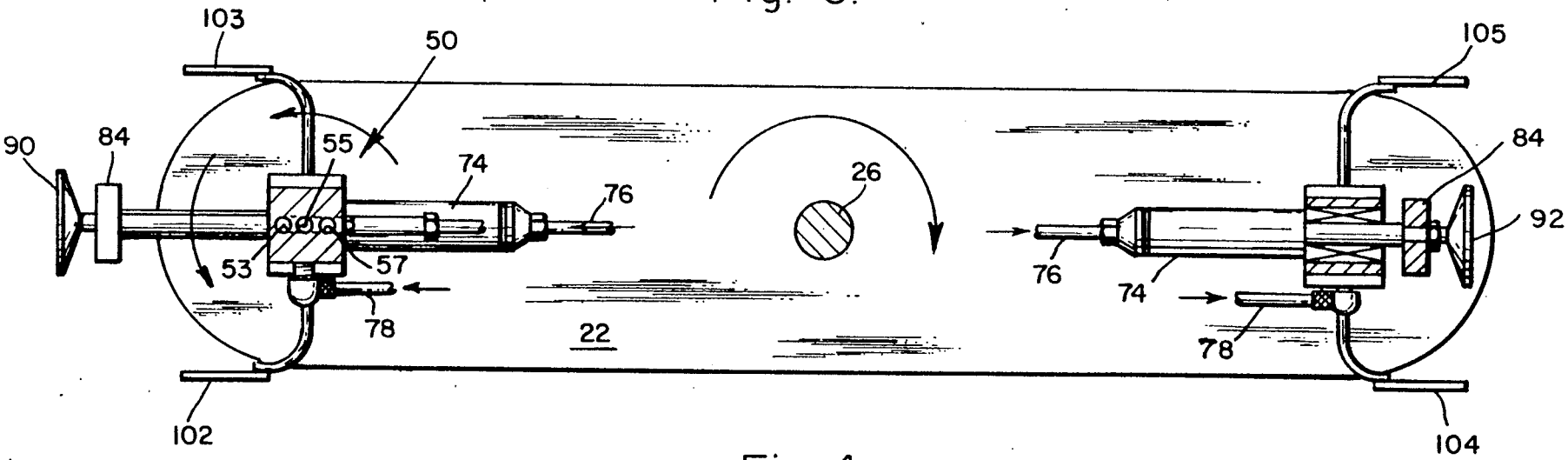
FIG. 3 is a cross-sectional view taken along line 3—3 of FIG. 1.

The air movement and suction assembly will now be described. Attached to the back of station post 52 is a fixed block 64 which in turn houses a pair of bearings 66 and 68. Two parallel movable shafts 70 and 72 are supported on the two linear bearings, with one bearing 66 supporting one shaft 70 and the other bearing 68 supporting the second shaft 72. A central air cylinder 74 extends through the block 64 and is attached to central post 52. A pair of air lines 76 and 78 are attached to the air cylinder. First air line 76 is attached to the back of the air cylinder 74 and second air line 78 is attached adjacent the front of the air cylinder 74 and therefore extends through station post 52 since air cylinder 74 extends through block 64 and into station post 52. In addition to FIG. 2, the air cylinder 74 is illustrated in greater detail in FIG. 3. The interior of the air cylinder 74 includes a movable piston 80. The piston in turn is attached to a movable rod 82 of the air cylinder 74. The two parallel movable shafts 70 and 72 and the central movable rod 82 of the air cylinder 74 are attached to a common transverse plate 84. When air is injected into the back of the air cylinder through first air line 76, the movable rod 82 of the piston 80 is caused to move away from the station post 52 and this in turn causes both parallel shafts 70 and 72 to move with the piston 80 and rod 82 and the two shafts 70 and 72 and rod 82 in turn cause the transverse plate 84 to move forward away from central post 52. When air is injected through second air line 78 in the front of the air cylinder 74, the piston 80 moves toward the station post 52 and into the air cylinder 74, and this in turn causes the movable rod 82 of the air cylinder 74 to move toward the central post 52 and also causes the two parallel shafts 70 and 72 and the transverse plate 84 to move toward the station post 52. The transverse plate 84 supports thereon a pair of spaced apart suction cup hollow rods 86 and 88 which in turn each support a suction cup 90 and 92 thereon. Suction cup hollow rod 86 moves back and forth within station post 52. A first vacuum line 96 is inserted into the rear of first hollow suction cup rod 86 so that a vacuum can be created in first suction cup 90. Similarly, a second vacuum line 96 is inserted into the rear of second hollow suction cup rod 88 so that a vacuum can be created in second suction cup 92. Suction cup hollow rod 88 moves back and forth within station post 52. It will be appreciated that the illustrated design of a pair of hollow suction cup rods and associated suction cups is only one embodiment within the spirit and scope of the present invention. The present invention can be operable with at least one hollow suction cup rod and associated suction cup and may also include any multiplicity of such hollow suction cup rods and associated suction cups and vacuum lines which are spread apart on the transverse plate to form a grid of spaced apart suction cup means. Spaced apart from each other on station post 52 are two pairs of fixed post members, with one post from each pair 102 and 104 being shown. The post from each pair not shown is in the same plane as and generally parallel to the shown post. The post members are outside the moving plane of the transverse plate 84, the movable parallel shafts 70 and 72, the moving air cylinder rod 82, and moving hollow suction cup rods 86 and 88.

The station post 52 extends through top plate 24 and a rotary seal 110 is affixed to the central shaft 52 by means of flange 112. Therefore the air lines and vacuum line can pass through the rotary seal 110 and through the hollow shafts 53, 55 and 57 inside interior 51 of central post 52, which shafts extend to the air lines and vacuum lines respectively.

Central shaft 26 is attached to bottom plate 22 by hub 114 and to top plate 24 by hub 116. Central plate 26 also extends through fixed top plate 120 through bearing 122. The fixed top plate 120 and fixed bottom plate 40 support the entire assembly. Attached at the top of central shaft 26 is the main air and vacuum supply valve 130. The two air lines 76 and 78 extend out of the main air and vacuum supply valve 130 and then extend into the rotary seal 110 and in turn extend through the station post 52 to the air cylinder 74 as previously described. Similarly, the vacuum line 96 extends out of the main air and vacuum supply valve 130 and then extends into the rotary seal 110 and in turn extends through station post 52 to the hollow suction cup rod 86. A T-connection 95 branches off vacuum line 96 to vacuum line 98 which in turn extends to hollow suction cup rod 88. The main air and vacuum supply valve 130 is stationary and a multiplicity of seals 132 keep the air and vacuum within the main air and vacuum supply valve as the central shaft 26 rotates.

Figure 5:
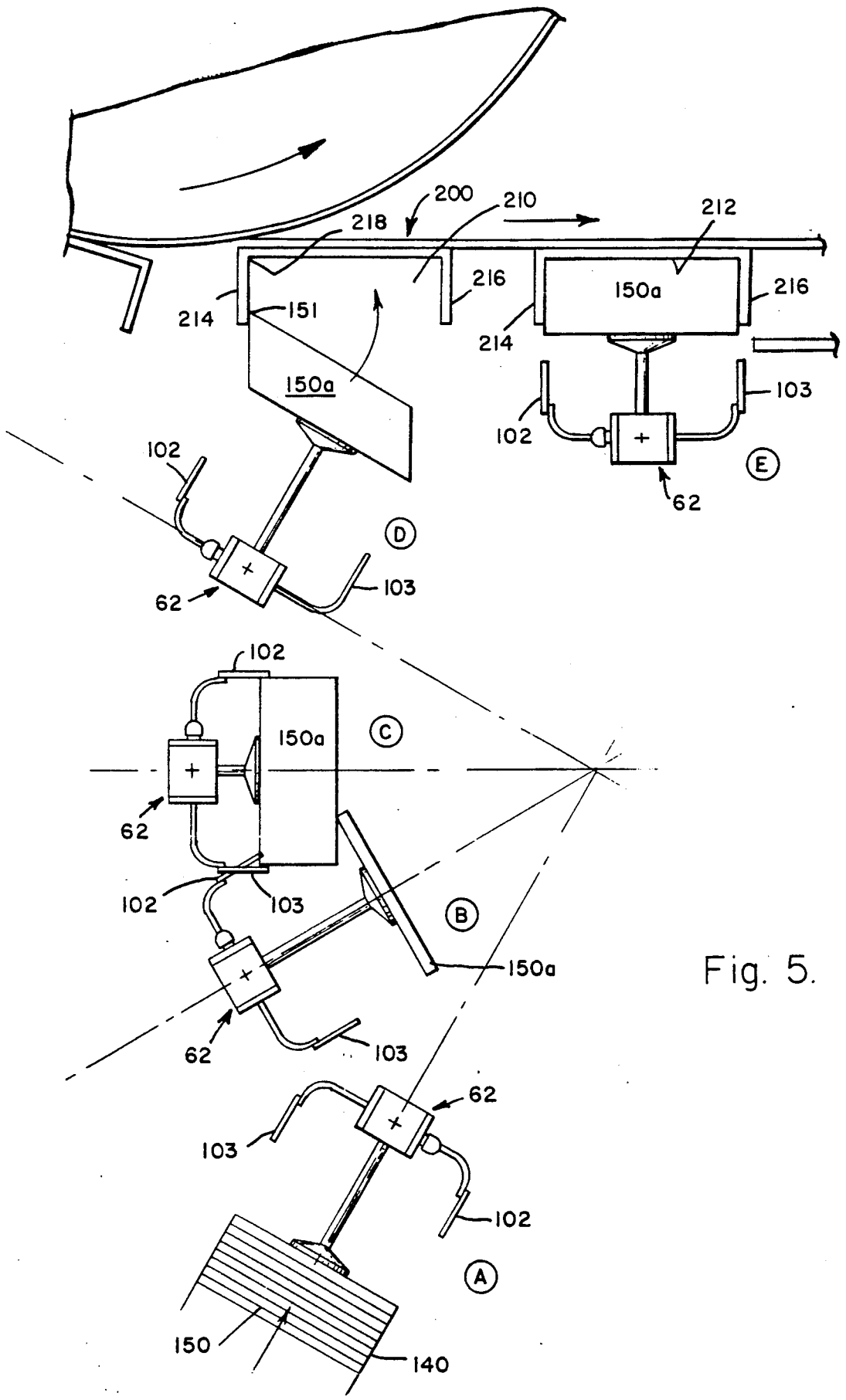
FIG. 5 is a diagrammatic view of the suction attaching and retaining means illustrating the positions on g the machine as the suction attaching and retaining means removes a folded carton from a magazine and places it into the protruding walls of a certain retaining means on a conveyor assembly.

Referring to the diagrammatic view of FIG. 5, the operation of the machine will now be described. The central post 26, base plate 22 and top plate 24 rotate in the clockwise direction. Each operating station such as 62 rotates in the counterclockwise direction. A magazine 140 comprising a multiplicity of folded cartons 150 is positioned adjacent the perimeter of the carousel 20 and just beyond the reach of the suction cups 90 and 92. Prior to coming into alignment with the carousel 20, the suction cups and their respective support hollow rods 86 and 88, the shafts 70 and 72, the transverse plate 84, and the movable air cylinder rod 82 are in the retracted position. This position is also illustrated in the right half of FIG. 3. As the operating station 50 comes into alignment with the magazine 140 retaining the cartons 150, the air cylinder 74 is activated by air going through air line 76 and causes the piston 80 and movable rod 82 to move away from the station post 52 such that the suction cups (such as 90 and 92) are affixed to the first carton in the magazine 140. The vacuum is also timed such that the vacuum is on just before the suction cups 90 and 92 attach to the carton 150*a*. As previously discussed, the rotation of the central post 26 and the lower base 22 and upper base 24 are opposite to the rotation of the station post 52 so that the linear velocity of the suction cups 90 and 92 to the fixed magazine 140 holding the cartons 150 is zero at the moment the suction cups 90 and 92 attach to the first carton 150*a*. Due to the combined rotational motion of the carousel and the station post 52, immediately after the suction cups 90 and 92 attach to the first carton 150*a*, the rotation of the station post 52 causes the first attached carton 150*a* to be removed from the magazine 140. This is the view in area "A" of FIG. 5. After the carton 150*a* has been completely removed from the magazine 140, the air cylinder 74 is actuated by air going through air line 78 and causes the piston 80 and air cylinder rod 82 to move toward the central post which in turn causes the suction cups to move toward the station post 52 and cause the carton 150*a* to move toward the station post 52 and also toward the two outer transverse fixed posts, two of which 102 and its horizontally aligned and parallel post 103 are shown in FIG. 5 as well as toward post 104 also shown in FIG. 2 and its comparable horizontally aligned and parallel fixed post. This is the view shown in area "B" of FIG. 5. When the attached face of the carton comes in contact with the two pairs of fixed posts, then the carton 150*a* is at least partially broken open by the impact of the carton 150*a* against the fixed transverse posts 102, 103, 104 and the one not shown. The carton may also be totally broken open at this time. This is the view illustrated in area "C" of FIG. 5. As is apparent from the diagrammatic view of FIG. 5, as the carousel 20 continues to rotate, the operating station 50 also rotates and the retained carton 150*a* also rotates with operating station 50. As the carousel 20 continues to rotate to come into alignment with a conveyor assembly 200, at the time the carton 150*a* is at approximately 30 to 40 degrees relative to the conveyer assembly 200, the air cylinder 74 is once again activated with air from air line 76 to cause the piston 80 and piston rod 82 and therefore the suction cups 90 and 92 and carton 150*a* to move away from the station post 52. At this point in time, the remainder of the carton 150*a* which is not attached to the suction cups 90 and 92 is hanging in the air in a partially opened position. As the carousel 20 continues to rotate, the partially opened carton 150*a* is brought into alignment with a respective carton receiving and retaining means 210 on the conveyor 200. The retaining and receiving means 210 is essentially a retaining pocket having a back wall 212 and a pair of transverse side walls 214 and 216. The remote corner 151 of the partially opened carton 150*a* comes in contact with the corner intersection 218 of a sidewall 214 and the rear wall 212 of the carton receiving and retaining means 210 of the conveyer 200 and this impact causes the carton 150*a* to be fully opened and pushed into the pocket of the receiving and retaining means of the conveyor. This is the view shown in area "D" of FIG. 5. As illustrated in area "E" of FIG. 5, after the carton 150*a* is inside the pocket of the receiving means and retaining means of the conveyor, the vacuum is released and the suction cups 90 and 92 are caused to move away from the carton by the combined act of the rotation of the carousel 20 and the activation of the air cylinder 74 and air from air line 78 to cause the suction cups 90 and 92 and associated apparatus to move away.

Figure 6:
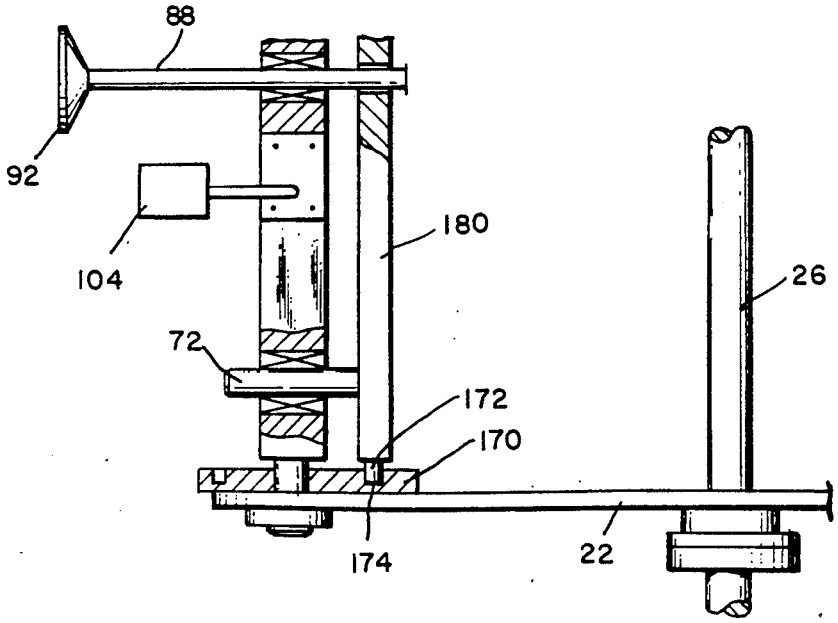
FIG. 6 is a partial side elevational view of the present invention processing machine for opening and retaining folded flat cartons and positioning them on a conveyor assembly system, utilizing a cam and cam follower assembly instead of a pneumatic air valve assembly for moving the suction attaching and retaining means into the carton attaching position and subsequently retracting it.

One alternative embodiment of the present invention involves the substitution of a cam and cam follower assembly for lateral movement of the suction cups relative to the station post 52 and which replaces the air cylinder assembly 74. Referring to FIG. 6, a first cam 170 is attached to base plate 22. A cam follower 172 in turn sits in the groove 174 of cam 170. Similarly, a second cam is attached to the top plate 24 and a second cam follower sits in the groove of the second cam. A vertical rod 180 interconnects the two cam followers. Incorporated into the embodiment of FIGS. 1 and 2 with the air cylinder assembly removed, the two parallel support rods 70 and 72 are attached to the vertical rod 180 and the hollow suction cup rods 86 and 88 are also attached to the vertical rod 180, and it is the movement of the cam followers which cause the vertical rod 180 to move relative to the station post 52 that cause the two support rods 70 and 72 and the two hollow suction cup rods 86 and 88 to move away from or toward the vertical rod 180 and thereby cause the transverse plate and the suction cups 90 and 92 to move toward or away from the station post 52. In the embodiment of FIG. 6, the parallel support rods 70 and 72 have been moved closer to their respective cams 170 and th eupper cam not shown for stability, but otherwise the operation is the same.

It will be appreciated that with a multiplicity of spaced apart operating stations 50, the rotation of each of the operating stations which is determined by the size of its outer sprocket 56 and the distance of the outer sprocket 56 to the main sprocket 28 is timed so that each operating station removes a carton from the magazine and places it in a respective receiving and retaining means of the conveyor, with each operating station not interfering with the others.

Therefore, through use of the present invention, the process of removing folded boxes or cartons from a magazine and opening them up and placing them within the retaining walls of a conveyer assembly is fully automated so that many cartons can be efficiently opened and placed on the conveyor assembly in a very efficient manner and utilizing a minimum of space due to the carousel nature of the machine.

It will be further appreciated that the assembly comprising the two suction cups 90 and 92, may more generally be referred to as vacuum attaching and retaining means. That is because suction cups designed to accommodate the support rods and the vacuum system are only one of such attaching means which can retain and transport a carton in the manner previously described. The vacuum retaining and transporting assembly comprises the suction cups 90 and 92, their associated hollow support rods 84 and 88, and the associated vacuum system.

Therefore, the present invention may be defined as an apparatus for removing a selected carton from a magazine comprising a multiplicity of stacked flat folded cartons, opening the selected carton and placing it in a carton receiving and retaining means of a conveyor assembly, the apparatus comprising:

a. a carousel having a base plate, a top plate spaced apart from the base plate, a central post extending through both the base plate and the top plate and means attached to said central post for causing the carousel to rotate in a given direction;

b. at least one operating station comprising a station post positioned on said carousel radially outward from said central post and rotatably supported between said base plate and said top plate and means interconnecting the station post to said central post to cause the station post to rotate in the opposite direction to the direction of rotation of said carousel;

c. a suction attaching and retaining means movably supported on said station post and connected to a vacuum suction source;

d. means for causing said suction attaching and retaining means to move radially inward toward said station post and outward from said station post;

e. a multiplicity of transverse posts supported on and extending radially outward from said station post and aligned adjacent the suction attaching and retaining means and spaced to permit the suction attaching and retaining means to move inward toward the station post and radially outward away from the station post;

f. said carousel located adjacent said magazine such that the multiplicity of stacked folded cartons face the carousel and the suction attaching and retaining means, and the relative speed of rotation of the carousel and station post are coordinated to cause the linear velocity of the suction attaching and retaining means to be zero at the moment the suction attaching and retaining means is aligned with the closest folded carton in the magazine;

g. said carousel located adjacent said conveyor assembly with the carton receiving and retaining means facing the carousel and with the conveyor assembly spaced apart from said magazine;

h. whereby said carousel is caused to rotate to cause the at least one operating station to sequentially come into alignment with the magazine and with the conveyor assembly, and when said suction attaching and retaining means is almost aligned with said magazine, said means for causing said suction attaching and retaining means to move radially inward toward and outward from said station post causes said suction attaching and retaining means to move radially outward and to come in contact with the closest folded carton in said magazine at the moment the suction attaching and retaining means is aligned with the folded carton and said vacuum suction source causes the closest carton to be attached to and carried away from said magazine by the suction attaching and retaining means, and the suction attaching and retaining means is caused to move inwardly toward said station post such that the carried folded carton comes in contact with said fixed posts which upon impact cause the carried folded carton to be at least partially broken open and when said carousel is aligned with said conveyor assembly, said suction attaching and retaining means is once again caused to move radially outward from said station post and the carton is caused to engage the carton receiving and retaining means of the conveyor assembly and become fully opened and the suction source thereupon releases the opened carton into the carton receiving and retaining means and the suction attaching and retaining means is once again caused to move radially inward toward said station post.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for removing a selected carton from a magazine comprising a multiplicity of stacked flat folded cartons, opening the selected carton and placing it in a carton receiving and retaining means of a conveyor assembly, the apparatus comprising:

a. a carousel having a base plate, a top plate spaced apart from the base plate, a central post including a lower end extending through the base plate and an upper end extending through the top plate, the lower end of the central post extending through a main fixed sprocket, a coupling member and a gear reducer which in turn is connected to a means for causing the carousel to rotate in a given direction;

b. at least one operating station comprising a station post positioned on said carousel radially outward from said central post, rotatably supported between said base plate and said top plate, extending through said base plate and connected to an outer sprocket, and means interconnecting the outer sprocket to said main fixed sprocket wherein as said carousel is caused to rotate, said fixed sprocket which does not rotate with said carousel causes the outer sprocket and the station post to rotate in the opposite direction to the direction of rotation of said carousel;

c. a fixed block attached to said station post and movably supporting a pair of parallel movable shafts which extend through the block, through said station post and radially outward from said station post and supporting a transverse plate at a distance radially outward from said station post;

d. an air cylinder supported by said block and further comprising a movable piston and piston rod which extends radially outward from said station post and terminates at said transverse plate, an air line connected to the air cylinder to cause the piston and piston rod to move radially inward toward said station post and outward away from said station post, and the air line also connected to an air supply source;

e. a pair of spaced apart hollow rods supported by said transverse plate and extending in a direction radially outward from said station post, each hollow rod having a front end which supports a suction cup and a rear end to which is attached a vacuum suction line leading to a vacuum source;

f. said air supply source, said air cylinder and said piston and piston rod causing said transverse plate and said suction cup hollow rods and said suction cups to move radially inward toward said station post and outward away from said station post;

g. a multiplicity of transverse posts supported on and extending radially outward from said station post and aligned adjacent said suction hollow rods and suction cups and spaced to permit said suction hollow rods and suction cups, said pair of parallel movable shafts, said transverse plate, said piston and piston rod to move radially inward toward said station post and outward away from said station post;

h. said carousel located adjacent said magazine such that said multiplicity of stacked folded cartons face said carousel and said suction cups, and the relative speeds of rotation of said carousel and said station post are coordinated to cause the linear velocity of said suction cups to be zero at the moment said suction cups are aligned with the closest folded carton in said magazine; and i. said carousel located adjacent said conveyor assembly with said carton receiving and retaining means facing said carousel and with said conveyor assembly spaced apart from said magazine;

j. whereby said carousel is caused to rotate to cause said at least one operating station to sequentially come into alignment with said magazine and with said conveyor assembly, and when said suction cups are almost aligned with said magazine, said air supply source feeds air into said air cylinder to cause said piston and piston rod to move radially outward from said station post and thereby cause said suction cup hollow rods, said transverse plate and said suction cups to move radially outward away from said station post and to cause said suction cups to come in contact with the closest folded carton in said magazine at the moment said suction cups are aligned with the folded carton and said vacuum suction source causes the closest carton to be attached to and carried away from said magazine by said suction cups, and said air supply source then causes said piston and piston rod to move radially inward toward said station post thereby causing said suction cup hollow rods, said transverse plate and said suction cups to move radially inward toward said station post such that the carried folded carton comes in contact with said multiplicity of transverse posts which upon impact cause the carried folded carton to be at least partially broken open and when said carousel is aligned with said conveyor assembly, said suction cup hollow rods, said transverse plate and said suction cups are once again caused to move radially outward away from said station post and the carton is caused to engage said carton receiving and retaining means of said conveyor assembly and become fully opened and said suction source thereupon releases the opened carton into said carton receiving and retaining means and said suction cup hollow rods, said transverse plate and said suction cups are once again caused to move radially inward toward said station post.

2. The apparatus in accordance with claim 1 wherein said air source and said vacuum source are connected to a supply valve which in turn is connected to said upper end of said central post and said air line and said vacuum line of said at lest one operating station extend from the supply valve to a rotary seal located above said top plate and affixed to said station post, which in turn carries said air line and said vacuum supply line to said air cylinder and said hollow suction cup rods respectively.

3. An apparatus for removing a selected carton from a magazine comprising a multiplicity of stacked flat folded cartons, opening the selected carton and placing it in a carton receiving and retaining means of a conveyor assembly, the apparatus comprising:

a. a carousel having a base plate, a top plate spaced apart from the base plate, a central post including a lower end extending through both the base plate and an upper end extending through the top plate, the lower end of the central post extending through a main fixed sprocket, a coupling member and a gear reducer which in turn is connected to a means for causing the carousel to rotate in a given direction;

b. at least one operating station comprising a station post positioned on said carousel radially outward from said central post, rotatably supported between said base plate and said top plate, extending through said base plate and connected to an outer sprocket, and means interconnecting the outer sprocket to said main fixed sprocket wherein as said carousel is caused to rotate, said fixed sprocket which does not rotate with said carousel causes the outer sprocket and the station post to rotate in the opposite direction to the direction of rotation of said carousel;

c. a fixed block attached to said station post and movably supporting a pair of parallel movable shafts which extend through the block, through said station post and radially outward from said station post and supporting a transverse plate at a distance radially outward from said station post;

d. a first cam supported on said base plate, the first cam including a groove housing a cam follower, and a second cam supported on said top plate, the second cam including a groove housing a cam follower, and a vertical rod connected to both cam followers, the vertical rod aligned adjacent said block and said station post and connected to said pair of movable shafts;

e. a pair of spaced apart hollow rods supported by said transverse plate and extending in a direction radially outward from said station post, each hollow rod having a front end which supports a suction cup and a rear end to which is attached a vacuum suction line leading to a vacuum source;

f. said vertical rod causing said transverse plate and said suction cup hollow rods and said suction cups to move radially inward toward said station post and outward away from said station post as said vertical rod is moved by said cam followers moving in their respective cam grooves;

g. a multiplicity of transverse posts supported on and extending radially outward from said station post and aligned adjacent said suction hollow rods and said suction cups and spaced to permit said suction hollow rods and suction cups, said pair of parallel movable shafts, and said transverse plate to move radially inward toward said station post and outward away from said station post;

h. said carousel located adjacent said magazine such that said multiplicity of stacked folded cartons face said carousel and said suction cups, and the relative speeds of rotation of said carousel and station post are coordinated to cause the linear velocity of said suction cups to be zero at the moment said suction cups are aligned with the closest folded carton in said magazine; and i. said carousel located adjacent said conveyor assembly with said carton receiving and retaining means facing said carousel and with said conveyor assembly spaced apart from said magazine;

j. whereby said carousel is caused to rotate to cause said at least one operating station to sequentially come into alignment with said magazine and with said conveyor assembly, and when said suction cups are almost aligned with said magazine, said vertical rod causes said pair of shafts to move radially outward away from said station post and thereby cause said suction cup hollow rods, said transverse plate and said suction cups to move radially outward away from said station post and to cause said suction cups to come in contact with the closest folded carton in said magazine at the moment said suction cups are aligned with the folded carton and said vacuum suction source causes the closest carton to be attached to and carried away from said magazine by said suction cups, and said vertical rod then causes said pair of shafts to move radially inward toward said station post thereby causing said suction cup hollow rods, said transverse plate and said suction cups to move inwardly toward said station post such that the carried folded carton comes in contact with said multiplicity of transverse posts which upon impact cause the carried folded carton to be at lest partially broken open and when said carousel is aligned with said conveyor assembly, said suction cup hollow rods, said transverse plate and said suction cups are once again caused to move radially outward away from said station post and the carton is caused to engage said carton receiving and retaining means of said conveyor assembly and become fully opened and said suction source thereupon releases the opened carton into said carton receiving and retaining means and said suction cup hollow rods, said transverse plate and said suction cups are once again caused to move radially inward toward said station post.

* * * * *